United States Patent [19]

Ehret et al.

[11] 4,216,411

[45] Aug. 5, 1980

[54] UNDERWATER LIGHT ASSEMBLY WITH LOW-WATER CUT-OFF

[75] Inventors: Gordon F. Ehret, Alhambra; William N. Rowley, Palos Verdes Est.; Hermenegildo Espiritu, Cerritos, all of Calif.

[73] Assignee: Wylain, Inc., Dallas, Tex.

[21] Appl. No.: 931,872

[22] Filed: Aug. 8, 1978

[51] Int. Cl.[2] ..... H05B 37/02

[52] U.S. Cl. ..... 315/118; 307/117; 307/118; 315/119; 315/199; 315/309; 340/622; 362/267; 362/276; 362/295; 362/802

[58] Field of Search ..... 315/112, 118, 119, 194, 315/199, 309, 362; 200/61.04; 328/3, 4, 11; 340/618, 622; 307/117, 118; 361/106; 362/22, 276, 294, 295, 362, 373, 802, 267

[56] References Cited

U.S. PATENT DOCUMENTS

| | | | |
|---|---|---|---|
| 1,792,398 | 2/1931 | Rothen | 362/267 |
| 1,968,072 | 7/1934 | Creighton | 362/267 |
| 2,928,037 | 3/1960 | Lawrence | 323/68 |
| 3,187,204 | 6/1965 | Adkins | 307/117 |
| 3,192,379 | 6/1965 | De Garmo | 362/267 |
| 3,339,066 | 8/1967 | Hart | 362/267 |
| 3,356,908 | 12/1967 | Mitchell et al. | 361/170 |
| 3,445,677 | 5/1969 | Leftwich | 307/117 |
| 3,693,047 | 9/1972 | Hamstra | 307/117 X |
| 3,723,758 | 3/1973 | Sullivan | 307/117 |
| 3,761,737 | 9/1973 | Robbins, Jr. | 307/117 |
| 3,781,839 | 12/1973 | Bodge | 73/204 X |
| 3,858,106 | 12/1974 | Launius | 321/45 R |
| 3,914,592 | 10/1975 | Maxey | 362/802 X |
| 4,135,186 | 1/1979 | Minorikawa et al. | 340/622 |

*Primary Examiner*—Eugene R. LaRoche
*Attorney, Agent, or Firm*—Lane, Aitken & Ziems

[57] ABSTRACT

A wet-niche type lamp for providing underwater illumination in a swimming pool or the like includes an over-temperature protection circuit which interrupts the supply of electrical energy to the lamp when the level of the cooling water surrounding the lamp drops below a predetermined level. The circuit includes thermistor mounted in an heat exchange relationship with the surrounding water so that heat energy generated in the thermistor, as a consequence of the current flow through it, is normally transferred to the surrounding water. Should the level of the surrounding water drop below that of the thermistor, the thermistor heat energy quickly evaporates any remaining water film on the exterior surface of the thermistor to allow its temperature to rise. The control circuit, in response to the temperature increase, interrupts the flow of electrical energy to the lamp to prevent over-temperature operation.

8 Claims, 4 Drawing Figures

UNDERWATER LIGHT ASSEMBLY WITH LOW-WATER CUT-OFF

BACKGROUND OF THE INVENTION

The present invention relates to underwater illuminating lamps having over-temperature protection and, more particularly, to a submersible lamp structure designed to provide underwater illumination for swimming pools and the like which is protected against over-temperature operation when the level of the water drops below a predetermined level.

Various lamps and lamp housing assemblies are known for providing underwater illumination for swimming pools, fountains, and the like. Some of these designs depend upon the presence of the surrounding water to absorb the excess heat energy developed by the lamp filament and thereby maintain the lamp and its housing in a preferred temperature range. However, when the level of the surrounding, cooling water inadvertently drops below the level of the operating lamp, the heat energy which would normally be transferred to the surrounding water causes the temperature of the lamp and its housing to increase and thereby cause an over-temperature condition. Repeated or extended over-temperature operation can materially reduce the operating life of the lamp filament; cause distortion and stress in the various parts of the lamp and lamp housing; and cause any plastic parts, including plastic sealing gaskets, structural elements, and electrical insulating parts, to distort, crack, or embrittle. Should the level of the cooling water be restored while the lamp is in an over-temperature condition, the resultant thermal shock can cause further material and structural deterioration, stress, and damage to the lamp and its housing.

A problem which must be considered in providing low-water protection for normally submerged lamps is that the temperature of the water and that of the ambient air, in those climates which have a small diurnal temperature variation over an extended period, can become approximately the same such that conventional temperature sensors may not be able to quickly discriminate between the presence or absence of the cooling water based on temperature alone.

SUMMARY OF THE INVENTION

In view of the above, it is a broad overall object of the present invention to provide an illuminating lamp structure which is protected against over-temperature operation.

It is another object of the present invention to provide a normally submerged illuminating lamp structure which is cooled by the surrounding water and which is protected against over-temperature operation when the level of the cooling water drops below a predetermined level.

It is another object of the present invention to provide a normally submerged illuminating lamp having a circuit which discriminates between the presence and absence of the surrounding cooling water.

It is still another object of the present invention to provide a normally submerged illuminating lamp structure having a circuit which interrupts the flow of electrical energy to the lamp when the level of the surrounding water drops below a predetermined level.

In accordance with these objects, and others, the present invention provides a normally submerged illuminating lamp structure which is cooled by the surrounding water and which includes a circuit that interrupts the flow of electrical energy to the lamp when the level of the cooling water drops below a predetermined level. The circuit includes a sensor, such as a temperature dependent resistor, mounted in a heat exchange relationship with the surrounding water. The sensor, when the level of the water drops below a predetermined level, causes the circuit to interrupt the flow of electrical energy to the lamp and thereby protect the lamp and its housing from over-temperature operation.

In the disclosed embodiment, a thermistor is mounted above the level of the lamp housing such that the surrounding water is in an heat exchange relationship with the thermistor. Electrical current flow through the thermistor causes heat energy to be developed which is normally transferred to the surrounding water to prevent the temperature of the thermistor from increasing. Should the level of the surrounding water drop below the level of the thermistor, the heat energy generated in the thermistor, normally transferred to the surrounding water, causes the temperature of the thermistor to increase. The circuit responds to this temperature increase by interrupting the electrical power to the lamp.

BRIEF DESCRIPTION OF THE DRAWINGS

The above description, as well as further objects, features, and advantages of the present invention will be more fully appreciated by reference to the following detailed description of a presently preferred but nonetheless illustrative embodiment in accordance with the present invention when taken in conjunction with the accompanying drawings wherein.

DETAILED DESCRIPTION OF THE PREFERRED EMBODIMENT

Figure 1:
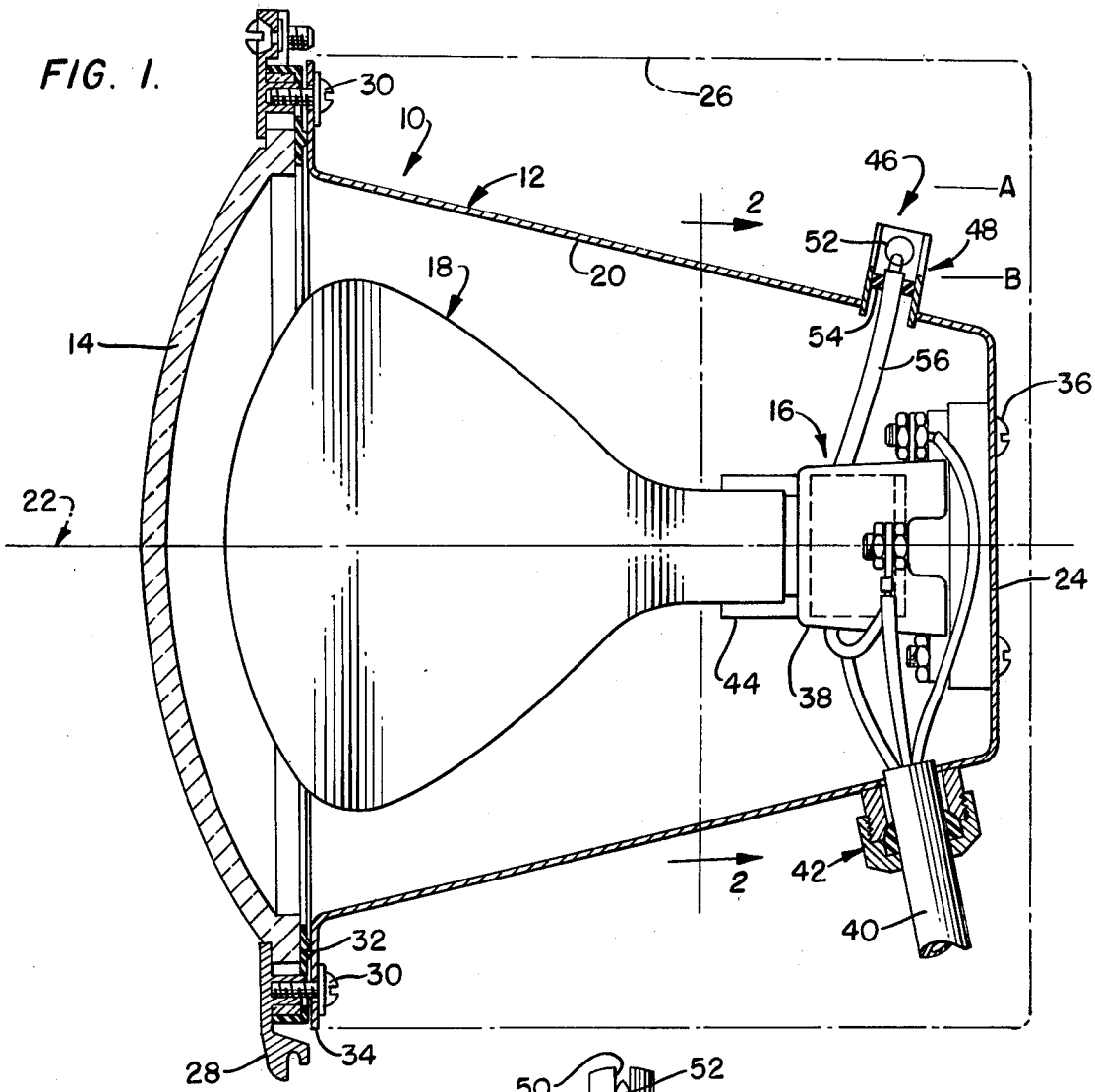
FIG. 1 is a side elevational view, in partial cross section, of an exemplary underwater illuminating lamp having a low-water cut-off to protect the lamp against over-temperature operation.
Figure 2:
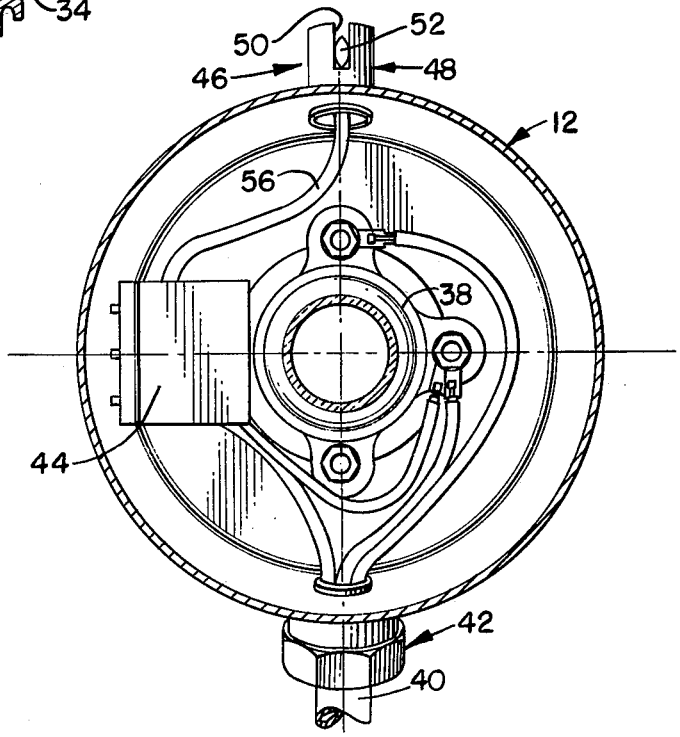
FIG. 2 is a cross-sectional view of the lamp shown in FIG. 1 taken along line 2—2 of FIG. 1.

As shown in FIGS. 1 and 2, the reference character 10 refers in general to an underwater illuminating lamp assembly in accordance with the present invention which includes a shell 12, a transparent lens 14, a lamp holder assembly 16, and an illuminating lamp 18.

The shell 12 includes frusto-conical sidewall 20 formed as a surface of revolution about a longitudinal axis 22 with the smaller-diameter end of the shell closed by an end wall 24, which may be formed as a unitary structure with the sidewall 20. The shell 12 is mounted, for example, in a cavity formed in the sidewall (not shown) of a swimming pool with the open, wider-end of the shell facing the interior of the pool. In FIG. 1 the cavity walls are schematically represented by the broken line 26. The shell 12 may be maintained in place by suitable means (not shown) such that water from the pool, when normally filled, occupies the space between the shell 12 and the cavity wall 26. The transparent lens 14 is located at the open, wider-end of the shell and is held in place by a lens retainer 28 and suitable threaded fasteners 30. A sealing gasket 32 is located between the rim of the lens 14 and a radially outward extending flange 34 of the shell to maintain a water-tight seal between the lens 14 and the shell 12.

The lamp holder assembly 16 is located at the narrow, closed-end of the shell 12 and is secured in place by suitable threaded fasteners 36 passing through holes (not shown) formed in the end wall 24 and engaging threaded bores in the body of the lamp holder assembly. The illuminating lamp 18, which may be in the form of a conventional incandscent lamp, is threaded into a lamp socket 38 such that it faces the interior of the pool. Electrical power for the lamp 18 is provided through a power cable 40 which passes through a water-tight fitting 42 into the interior of the shell 12. The power cable 42 includes a plurality of wires connected to various terminals on the lamp holder assembly 16 and to a control circuit module 44, which is described in more detail below. The lamp holder assembly 16 and the control circuit module 44 are preferably encapsulated in a water-proof potting compound to further protect the lamp assembly 10 from water.

A temperature probe 46 is located on the exterior of the shell and is designed to sense the presence or absence of water in the space between the shell and the cavity wall 26. The probe 46 include a short cylindrical extension 48 having two diametrically located slots 50 (FIG. 2). A thermal sensor 52 is located within the cylinder 48 and is maintained in place by a sealing plug or gasket 54. The thermal sensor 52 is connected to the control circuit module 44 by a wire 56 which extends through the gasket 54. The thermal sensor 52 may take the form of a conventional thermistor having a temperature dependent resistance material encapsulated in a water-proof epoxy coating. The temperature probe 52 is designed to sense the presence or absence of the surrounding, cooling water and, in cooperation with the control circuit shown in FIG. 3, interrupts the flow of electrical power to the lamp 18 when the water level drops below a predetermined level.

Figure 3:
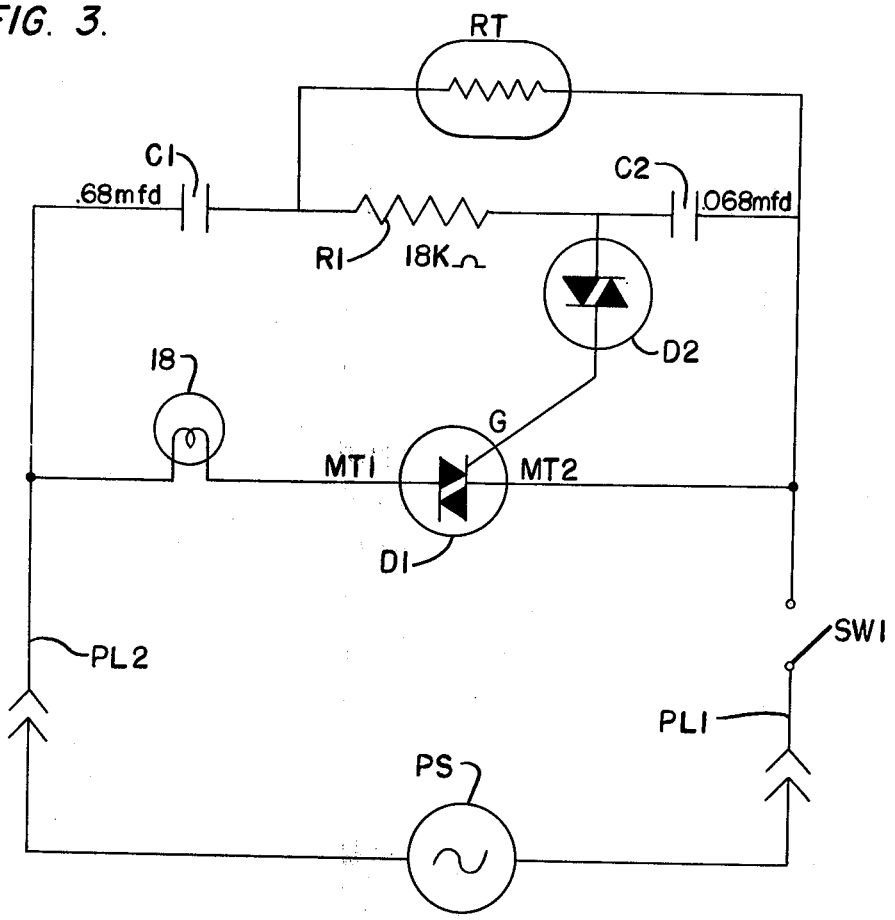
FIG. 3 is an electrical schematic diagram of a low-water cut-off circuit which provides over-temperature protection for the lamp shown in FIGS. 1 and 2.

A low-water over-temperature control circuit is shown in FIG. 3 and includes an electrically switchable TRIAC D1 having one of its main terminals MT2 connected to an input power line PL1 through a switch SW1 and the other of its main terminals MT1 connected to the lamp 18 filament. The other end of the lamp 18 filament is connected to the remaining input power line PL2.

Figure 4:
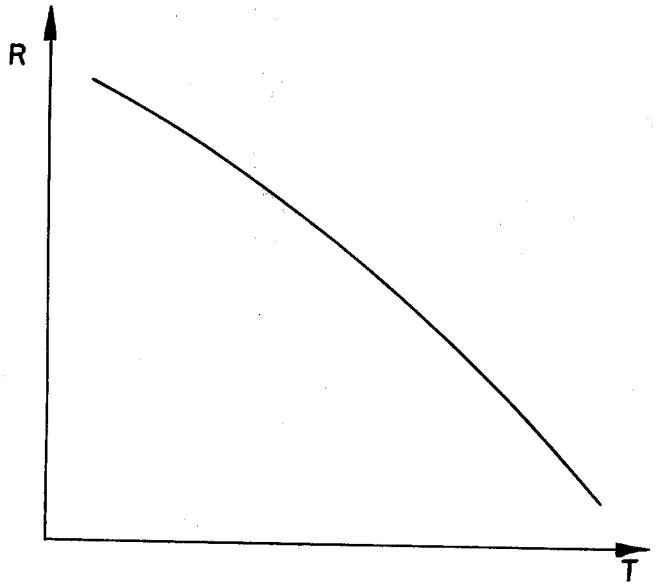
FIG. 4 is an idealized resistance-temperature characteristic curve for a temperature dependent resistor of the type shown in the schematic diagram of FIG. 3.

Trigger input pulses for switching the TRIAC D1 between its conductive and non-conductive states are provided by a triggering circuit which includes a DIAC D2, capacitors C1 and C2, a fixed resistor R1 and a thermally responsive thermistor RT, identified as the thermal sensor 52 in FIGS. 1 and 2. The resistor R1 and the capacitors C1 and C2 are serially connected, with one end of the capacitors C1 and C2 connected, respectively, to the power lines PL1 and PL2 and the other ends thereof connected, respectively, to the ends of the resistor R1. The thermistor RT is connected between the power line PL1 and the junction between the capacitor C1 and the resistor R1, and the DIAC D2 is connected between the gate terminal G of the TRIAC D1 and the junction between the resistor R1 and the capacitor C2. The thermistor resistance-temperature characteristics are selected such that it has a negative temperature coefficient (NTC), that is, the resistance of the thermistor decreases as its temperature increases as illustrated in the idealized graph of FIG. 4. Exemplary values for the capacitors C1 and C2 and the resistor R1 are shown in FIG. 3.

The control circuit of FIG. 3 functions to interrupt the flow of electrical power from a power source PS to the lamp 18 when the temperature of the thermistor RT is above a threshold value and to restore the electrical power to the lamp when the temperature decreases below the threshold value. In the preferred embodiment, the power is 60 HZ, 120 volt alternating current.

The electrical characteristics of the control circuit are selected such that a current flow is established through the thermistor RT with the magnitude of the current causing the thermistor RT to self-heat. When water is present in the cavity above the level of the probe 46, that is, level A in FIG. 1, the heat developed in the thermistor RT is quickly transferred to the surrounding water. As a consequence, the temperature of the thermistor RT is relatively low and its resistance relatively high. With power being applied to the control circuit through the switch SW1, current is caused to flow through the path defined by capacitor C1, resistor R1, and capacitor C2 and through the path defined by the capacitor C1 and the thermistor RT. Since the temperature of the thermistor RT is relatively low and its resistance is relatively high, the major portion of the current is through the path defined by the capacitor C1, the resistor R1, and the capacitor C2 with time varying voltage drops being developed across each of these components as a function of the magnitude of the current and their respective resistance and reactance. As the voltage at the junction between the resistor R1 and the capacitor C2 increases, it eventually reaches the breakover value of the DIAC D2 causing the DIAC to switch from its non-conducting state to its conducting state and thereby establish a triggering current pulse at the gate G of the TRIAC D1. The TRIAC D1 is thereby switched from its non-conductive state to its conductive state to allow current to flow through the lamp 18 filament and thereby turn the lamp 18 ON. When the supply voltage drops to cause the current through the TRIAC D1 to fall below the TRIAC holding current, the TRIAC will switch to its non-conductive state and turn the lamp 18 OFF. This operation of the TRIAC D1 continues on each successive alternation of the input power keeping the lamp 18 ON as long as the temperature of the thermistor is relatively high.

When the level of the cooling water in the cavity drops below the level of the probe 46, that is, level B in FIG. 1, the temperature of the thermistor RT increases because of the diminished heat transfer between the thermistor and the surrounding water. This temperature increase causes a consequent decrease in the thermistor internal resistance. As a consequence, the major portion of the current flow in the triggering circuit is through the path defined by the thermistor RT and the capacitor C2 rather than through the path defined by the capacitor C2, the resistor R1, and the capacitor C2. Therefore the voltage at the junction between the resistor R1 and the capacitor C2 will not rise above the break-over voltage of the DIAC D2. Thus, as long as the thermistor RT resistance remains low because of the low-water over-temperature condition, the TRIAC D1 will not be switched to its conductive state and the lamp 18 will be prevented from turning ON.

When the level of the cooling water is restored, that is, to or above the level A in FIG. 1, the heat energy developed in the thermistor RT will again be transferred to the surrounding water and its temperature will drop with a consequent rise in its internal resistance. As described above, the voltage at the junction of the resistor R1 and the capacitor C2 will rise above the breakover voltage of the DIAC 2 on each successive alternation of the input power causing the control circuit to resume its normal operation.

The heat energy developed in the thermistor R2 enhances the ability of the control circuit to discriminate between the presence and absence of the surrounding water by accelerating the evaporation of the water film that remains on the thermistor body as the water drops below the level of the probe 46. This feature is especially useful in those climates where the variation between the daytime and nightime temperatures over an extended period of time is not great allowing the temperature of the water to approach that of the ambient air.

While the present invention has been described in the context of an underwater lamp for illuminating a swimming pool, the present invention can be used as a submersible lamp for illuminating the interior of pools and tanks containing liquid other than water, such as oil and chemical/water mixtures.

As is apparent to those skilled in the art, various changes and modifications may be made to the lamp assembly of the present invention without departing from the spirit and scope of the invention as recited in the appended claims and their legal equivalent.

What is claimed is:

1. A liquid-cooled wet-niche lamp structure for providing underwater illumination in water-containing pools or the like and protected against over-temperature operation, said lamp structure comprising:

a lamp housing adapted to receive an illuminable lamp therein;

said lamp housing adapted to be supported in a heat exchange relationship with a surrounding liquid cooling media and having a power circuit for connecting a source of electrical power to the lamp;

a thermally responsive sensor having a negative temperature coefficient for detecting the presence or absence of the liquid cooling media; and control circuit means connected to said sensor to interrupt the flow of electrical power to the lamp in the absence of the liquid cooling media and to resume the flow of electrical power to the lamp in the presence of the liquid cooling media, said control circuit means adapted to provide a flow of electrical current through said thermally responsive sensor to effect self-heating thereof and including a semi-conductor switch connected to said sensor and said power circuit, said sensor, when normally cooled by the liquid cooling media, maintaining said semi-conductor switch in a conductive state to provide a flow of electrical current to the lamp, and said sensor, in the absence of the liquid cooling media, causing said semi-conductor switch to switch to a non-conductive state to interrupt the flow of electrical current to the lamp, said thermally responsive sensor and said control circuit means electrically insulated from said liquid cooling media.

2. The liquid cooled lamp structure claimed in claim 1 wherein:

said thermally responsive sensor comprises a temperature sensitive resistor.

3. The liquid-cooled lamp structure claimed in claim 2, further comprising:

a hollow cylindrical shroud mounted on an external surface of said lamp housing, said temperature sensitive resistor located within said shroud.

4. The liquid-cooled lamp structure claimed in claim 3, wherein said shroud is provided with at least one slot to permit the liquid cooling media to drain from said shroud.

5. The liquid cooled lamp structure claimed in claim 1, wherein said control circuit means further comprises:

a TRIAC connected in said lamp power circuit to selectively interrupt and resume the flow of electric power to said lamp, said control circuit selectively gating said TRIAC in response to said thermally responsive sensor.

6. The liquid cooled lamp structure claimed in claim 5, wherein said control circuit further comprises:

a series RC circuit and a bi-directional trigger device connected between an intermediate point in said RC circuit and the gate of said TRIAC.

7. The liquid cooled lamp claimed in claim 6, wherein said thermally responsive sensor comprises:

a temperature dependent resistor connected in said control circuit.

8. The liquid cooled lamp structure claimed in claim 7, wherein:

said temperature dependent resistor is adapted, when it is at a low resistance, to shunt a portion of said RC circuit to prevent said TRIAC from being gated.

* * * * *